US009708832B2

(12) United States Patent
Binek et al.

(10) Patent No.: US 9,708,832 B2
(45) Date of Patent: Jul. 18, 2017

(54) LOCK CORE WITH RECESSED POP OUT KNOB

(71) Applicant: UTC Fire & Security Corporation, Farmington, CT (US)

(72) Inventors: Lawrence Binek, Glastonbury, CT (US); Ritesh Khire, South Windsor, CT (US); Andrzej Ernest Kuczek, Bristol, CT (US); Ulf J. Jonsson, South Windsor, CT (US); Vijaya Ramaraju Lakamraju, Longmeadow, MA (US); Adam Kuenzi, Silverton, OR (US); Wayne Floyd Larson, Salem, OR (US); Matthew S. Hill, Sublimity, OR (US)

(73) Assignee: UTC FIRE & SECURITY CORPORATION, Farmington, CT (US)

( * ) Notice: Subject to any disclaimer, the term of this patent is extended or adjusted under 35 U.S.C. 154(b) by 0 days.

(21) Appl. No.: 14/772,454

(22) PCT Filed: Feb. 25, 2014

(86) PCT No.: PCT/US2014/018276

§ 371 (c)(1),
(2) Date: Sep. 3, 2015

(87) PCT Pub. No.: WO2014/137665

PCT Pub. Date: Sep. 12, 2014

(65) Prior Publication Data

US 2016/0017639 A1 Jan. 21, 2016

Related U.S. Application Data

(60) Provisional application No. 61/772,855, filed on Mar. 5, 2013.

(51) Int. Cl.
*G08C 19/00* (2006.01)
*E05B 47/00* (2006.01)
(Continued)

(52) U.S. Cl.
CPC ..... *E05B 47/0005* (2013.01); *E05B 5/006* (2013.01); *E05B 47/0001* (2013.01);
(Continued)

(58) Field of Classification Search
CPC ..... E05B 47/0005
(Continued)

(56) References Cited

U.S. PATENT DOCUMENTS

2001/0025517 A1 10/2001 Bates et al.
2006/0185407 A1 8/2006 Priest
(Continued)

FOREIGN PATENT DOCUMENTS

CN 1900470 A 1/2007
CN 102434042 A 5/2012
(Continued)

OTHER PUBLICATIONS

International Search report of the International Application No. PCT/US2014/018276 mailed Aug. 20, 2014.
(Continued)

*Primary Examiner* — Qutbuddin Ghulamali
(74) *Attorney, Agent, or Firm* — Cantor Colburn LLP

(57) ABSTRACT

A lock core for a lock assembly is provided including a housing having a first end. An operating member is configured to move between a retracted position and an extended position. When the operating member is in the retracted position, the operating member is at least partially recessed within the housing. A control member is arranged within the housing and is configured to selectively limit movement of the operating member between the retracted position and the
(Continued)

extended position. The control member is operably coupled to the controller via an actuator.

11 Claims, 4 Drawing Sheets

(51) Int. Cl.
*E05B 47/06* (2006.01)
*E05B 5/00* (2006.01)
*E05B 49/00* (2006.01)
*G07C 9/00* (2006.01)

(52) U.S. Cl.
CPC ..... *E05B 47/0611* (2013.01); *E05B 47/0615* (2013.01); *E05B 49/002* (2013.01); *G07C 9/00174* (2013.01); *E05B 2047/0017* (2013.01); *E05B 2047/0065* (2013.01); *E05B 2047/0072* (2013.01); *E05B 2047/0088* (2013.01); *E05B 2047/0094* (2013.01)

(58) Field of Classification Search
USPC ..... 340/5.7; 70/278.7
See application file for complete search history.

(56) References Cited

U.S. PATENT DOCUMENTS

2012/0324969 A1* 12/2012 Goldman ..... E05B 47/0615 70/283
2013/0014552 A1* 1/2013 Bench ..... E05B 47/0673 70/278.7
2016/0017639 A1* 1/2016 Binek ..... E05B 47/0615 340/5.7

FOREIGN PATENT DOCUMENTS

| | | | |
|---|---|---|---|
| CN | 102741490 | A | 10/2012 |
| EP | 0784140 | A1 | 7/1997 |
| WO | 03064794 | A1 | 8/2003 |
| WO | 2009109972 | A1 | 9/2009 |
| WO | 2011089612 | A1 | 7/2011 |

OTHER PUBLICATIONS

Written Opinion of the International Searching Authority for International Application No. PCT/US2014/018276 mailed Aug. 20, 2014.
Chinese Office Action with Search Report for Application No. 201480012795.6; Filing Date: Feb. 25, 2014; Dated: Nov. 18, 2016; 10 pgs.
English Abstract for CN102434042A—May 2, 2012; 2 pgs.
English Abstract for CN102741490A—Oct. 17, 2012; 2 pgs.
English Abstract for CN1900470A—Jan. 24, 2007; 1 pg.
English Translation of Chinese Office Action for Application No. 201480012795.6; Filing Date: Feb. 25, 2014; Dated: Nov. 18, 2016; 5 pgs.
English Translation of CN Search Report for Application No. 201480012795.6; Filing Date: Feb. 25, 2014; Dated: Nov. 18, 2016; 3 pgs.

* cited by examiner

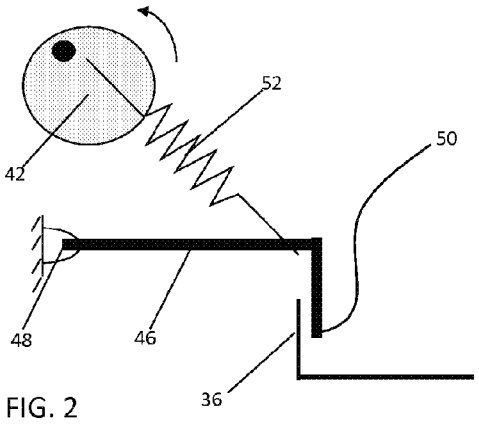
FIG. 2
FIG. 3
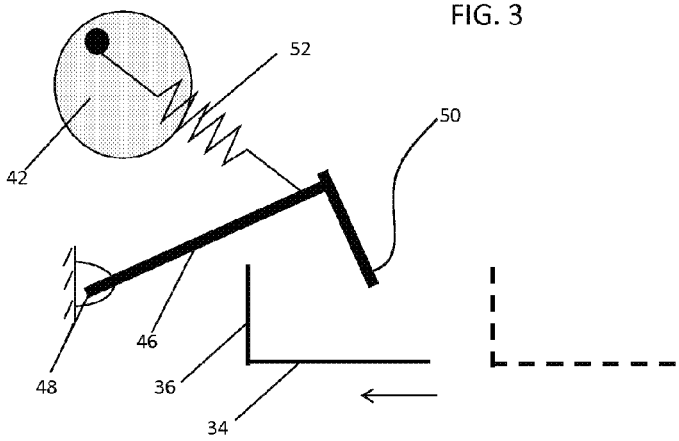

LOCK CORE WITH RECESSED POP OUT KNOB

CROSS-REFERENCE TO RELATED APPLICATIONS

This application claims the benefit of U.S. provisional patent application Ser. No. 61/772,855 filed Mar. 5, 2013, the entire contents of which are incorporated herein by reference.

BACKGROUND OF THE INVENTION

The invention relates generally to lock assemblies, and more particularly to lock assemblies having an operating member recessed within the lock core.

Typically, a lock comprises a lock member, such as a latch for example, an operating member such as a handle, which is operable to release the latch, and an operating mechanism for connecting the operating member to the latch. The operating mechanism is generally enabled by the presentation of a suitable key to the lock. Without the key, the operating member cannot be operated to release the latch. In some locks, the key itself is the operating member.

Some more modern locks have replaced the conventional metal key with a card having a magnetic strip bearing an access code. The lock is provided with a card reading device which is associated with the lock operating mechanism. Typically, the lock operating mechanism includes an electromechanical device which receives electrical signals from the card reader, and whether or not the operating mechanism is enabled depends on whether or not the electromechanical device is energized.

Numerous problems exist with conventional mechanical and/or electrical locking systems. Firstly, mechanical keys for the most part can be easily copied and distributed to unauthorized users. Also, if the key is ever lost or stolen, the entire lock cylinder may need replacing in order to assure that an unauthorized user does not gain access. When the door lock system is placed on the outside of the door, the lock may be tampered with or subject to vandalism. In addition, it can also be difficult to provide electronic lock hardware that mechanically interacts with existing door locks, and it can be especially difficult to provide electronic lock hardware that can be retrofitted into installed or mounted conventional door locks.

BRIEF DESCRIPTION OF THE INVENTION

According to one embodiment of the invention, a lock core for a lock assembly is provided including a housing having a first end. An operating member is configured to move between a retracted position and an extended position. When the operating member is in the retracted position, the operating member is at least partially recessed within the housing. A control member is arranged within the housing and is configured to selectively limit movement of the operating member between the refracted position and the extended position. The control member is operably coupled to the controller via an actuator.

According to another aspect of the invention, a method of unlocking a lock assembly is provided including receiving a valid authentication signal. A control member is moved to allow movement of an adjacent operating member between a retracted position and an extended position. The operating member is then biased to the extended position.

According to another aspect of the invention, a method of unlocking a lock assembly is provided including receiving a valid authentication signal. An actuator coupled to a control member configured to move an adjacent operating member between a retracted position and an extended position is moved. The control member is disengaged from the operating member, and the operating member is then biased from the retracted position to the extended position.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

FIG. 2 is a schematic illustration of a portion of the lock core after a controller receives a valid authentication signal according to an embodiment of the invention;

FIG. 3 is a schematic illustration of a portion of the lock core after a force is applied to the operating member according to an embodiment of the invention;

DETAILED DESCRIPTION OF THE INVENTION

Figure 1:
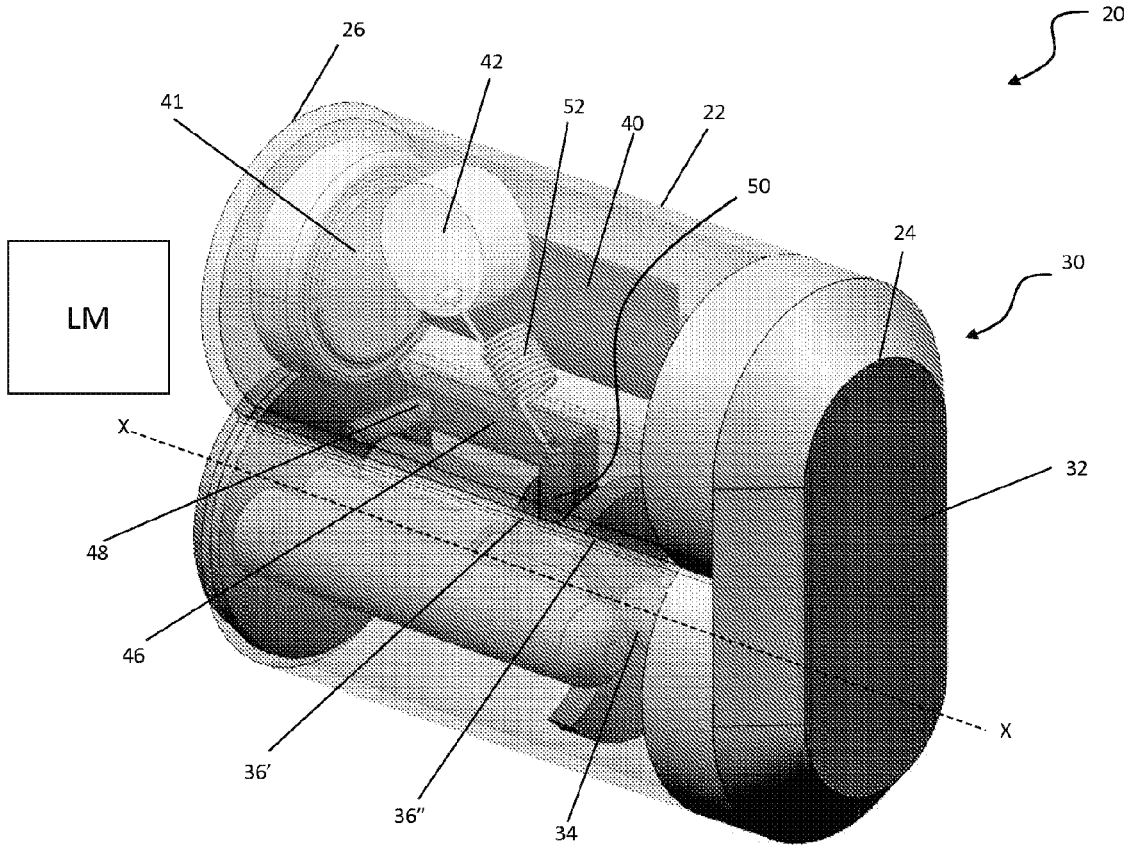
FIG. 1 is a perspective view of a lock core with a substantially transparent housing according to an embodiment of the invention.

An electromechanical lock core 20 of a lock assembly is illustrated in FIG. 1. The lock core 20 includes an outer housing 22 within which various components of the lock core 20 are housed. An operating member 30 is arranged adjacent a first end 24 of the housing 22, and is movable generally linearly between a retracted position and an extended position. When the operating member 30 is in the retracted position, as shown in FIG. 1, the operating member 30 is recessed within the housing 22 such that a first surface 32 of the operating member 30 is adjacent to or substantially aligned with the first end 24 of the housing 22. In one embodiment, the first surface 32 of the operating member 30 has a generally non-round shape that prevents rotation of the operating member 30 about an axis X when recessed within the housing 22. The operating member 30 may be formed from a durable material resistant to drilling and vandalism. The housing 22, or a portion thereof, such as the first end 24 for example, may similarly be formed from a strengthen material capable of withstanding vandalism.

The operating member 30 is operably coupled to a mechanical lock member (illustrated schematically by block LM) arranged adjacent the second end 26 of the housing 22. The operating member 30 may include a shaft 34 that extends at least partially into the interior of the housing 22. In the illustrated embodiment, the shaft 34 extends through the entire interior of the housing 22 to the adjacent lock member LM. In one embodiment, at least one engagement area 36, such as a protrusion or a recess for example, is arranged on a portion of the operating member 30. For example, as shown in FIG. 1, the shaft 34 includes a first engagement area 36' and a second engagement area 36" separated by a distance. The shape of the at least one engagement area 36 may be selected to prevent translation or rotation of the shaft 34 about an axis X as a result of interference with adjacent components housed within the housing 22.

The housing 22 additionally houses a controller 40 operably coupled to an actuator 42. A replaceable battery 41 may be configured to provide power to the controller 40 and the actuator 42. The controller 40 is configured to receive an authentication signal from an external authentication device, such as a smartphone or an electronic key for example. The authentication device may be physically or wirelessly coupled to the controller 40. In one embodiment, an antenna (not shown) is coupled to the controller 40 and is arranged about the exterior of the housing 22, such as adjacent the first end 24 for example. The actuator 42 may be directly or indirectly coupled to a control member 46. The control member 46 is configured to retain the operating member 30 in the retracted position, recessed within the interior of the housing 22, until the controller 40 receives a valid authentication signal. In the illustrated embodiment, the control member 46 is a generally L-shaped lever pivotable about a first end 48 and connected to the actuator 42 with a biasing mechanism 52. An obstruction or protrusion (not shown) may extend from a portion of the housing 22 adjacent the control member 46 to limit movement of the control member 46 when the controller 40 has not received a valid authentication signal, such as when the lock core 20 is vibrated or vandalized for example. When the operating member 30 is recessed within the housing 22, a second end 50 of the control member 46 is arranged in contact with the at least one engagement area 36 to prevent the operating member 30 from translating about the axis X to the extended position.

Figure 4:
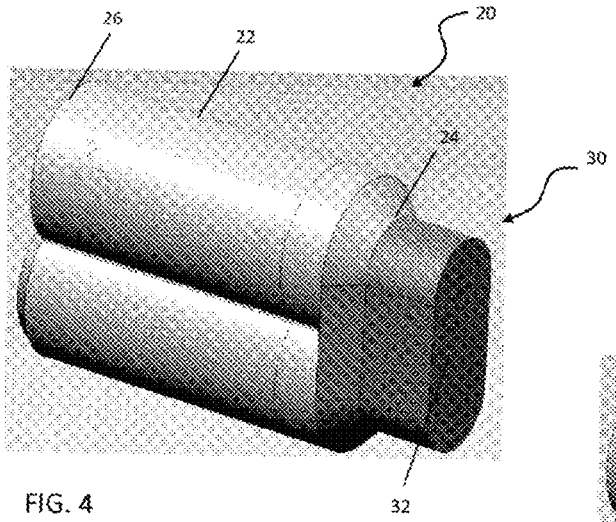
FIG. 4 is a perspective view of the lock core when the operating member is in an extended position according to an embodiment of the invention.

To operate the lock core 20 illustrated in FIG. 1, a person places an authentication device, such as a key or a cell phone for example, near the antenna, and thus the first end 24 of the lock core 20. The antenna transmits the authentication signal from the authentication device to the controller 40. In response to a valid authentication signal, the controller 40 will operate the actuator 42. In one embodiment, this movement of the actuator 42 will pivot the control member 46 out of engagement with the operating member 30; however, in the illustrated embodiment, rotation of the actuator 42 creates a stored energy in the biasing mechanism 52 (FIG. 2). Application of a force to the front surface 32 of the operating member 30 causes the engagement area 36 to translate along axis X out of contact with the control member 46. As a result, the stored energy of the biasing mechanism 52 is released, causing the control member 46 to rotate away from the operating member 30 (FIG. 3). Once the control member 46 is moved away from the operating member 30, the operating member 30 is biased to the extended position (FIG. 4), such as by a biasing mechanism (not shown) positioned about shaft 34 for example.

Figure 5:
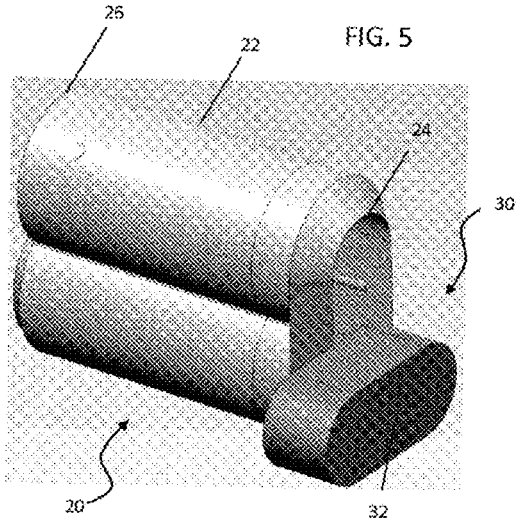
FIG. 5 is perspective view of the lock core when the operating member is in an extended position according to an embodiment of the invention.

To extend the life of the battery 41, the power required by the lock core 20 is minimized or eliminated when the operating member 30 is biased to the extended position; however, once the operating member 30 is returned to the retracted position, normal operation will resume. In the extended position, the operating member 30 may be rotated, as shown in FIG. 5, to operate the lock member LM coupled thereto, for example to open a door. The oblong shape of the operating member 30 assists an operator in rotating the operating member 30 to unlock the lock member LM. In one embodiment, once the operating member 30 reaches its end of travel, the operating member 30 is automatically returned to the retracted position within the housing 22 and the lock member LM coupled thereto is relocked. In another embodiment, a user must actively move the operating member 30 to the refracted position for the control member 46 to re-engage the operating member 30 and the lock member LM to lock.

Figure 6:
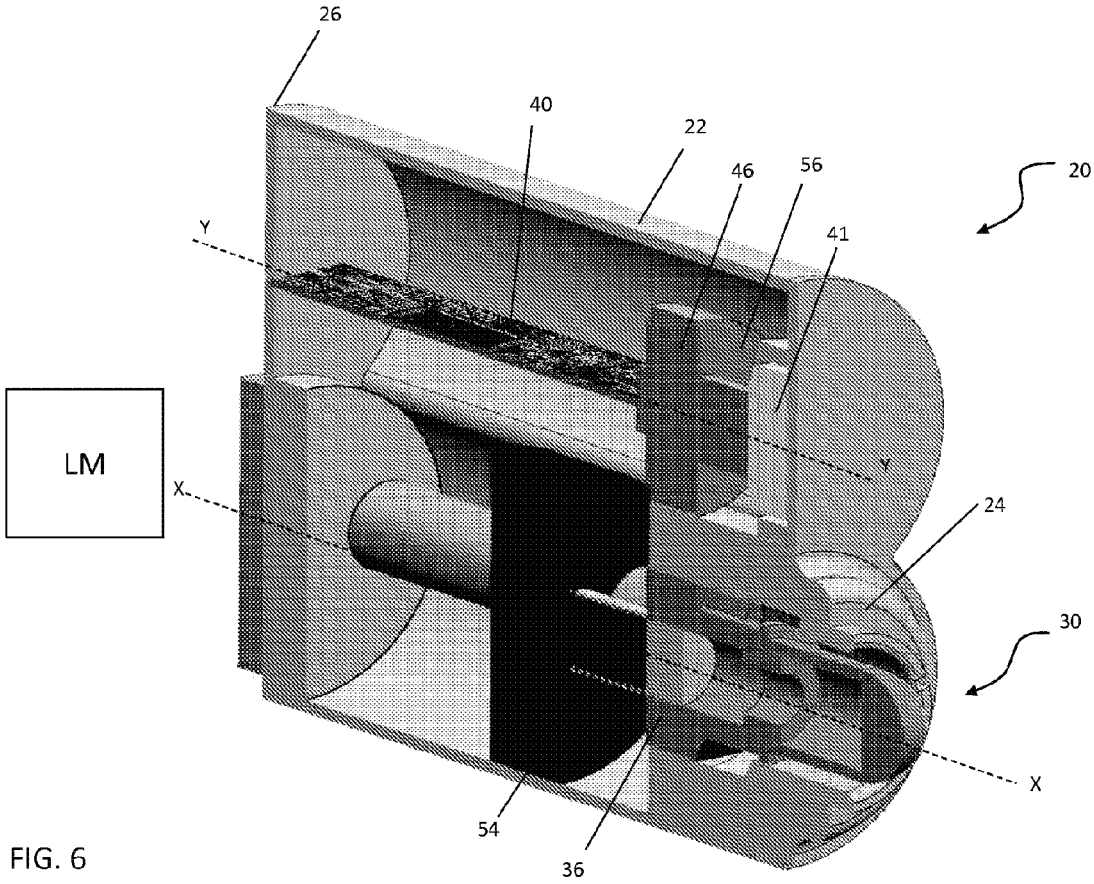
FIG. 6 is a cross-sectional view of another lock core according to an embodiment of the invention.

A lock core 20 according to another embodiment is shown in FIG. 6. In the illustrated embodiment, the operating member 30 includes a button configured to translate along an axis X between a retracted position and an extended position. The control member 46, arranged generally adjacent the operating member 30, is pivotable about an axis of rotation Y and includes a contact portion 56, such as a flange for example, extending partially about the periphery of the control member 46. The contact portion 56 of the control member 46 is configured to selectively engage the engagement area 36 of the operating member 30. When the contact portion 56 of the control member 46 and the engagement area 36 of the operating member 30 are in contact, the operating member 30 cannot translate generally linearly along axis X between the retracted position and the extended position. The controller 40 is similarly coupled to the control member 46 via an actuator 42 (not shown in FIG. 6).

Upon receipt of a valid authentication signal, the actuator 42 coupled to the controller 40 rotates the control member 46 about axis Y, to a first position, out of engagement with the engagement area 36 of the operating member 30. A sensor (not shown), operably coupled to the controller 40, may be used to detect if the operating member 30 is in the retracted position. If the sensor detects that the operating member is not in the retracted position, the controller may not operate the actuator upon receipt of a valid authentication signal. In one embodiment, a biasing mechanism 54 is configured to bias the operating member 30 to the extended position after the control member 46 is rotated out of contact with the engagement area 36 of the operating member 30. Once extended, translational or rotational movement of the operating member 30 may operate the lock member LM coupled thereto. In one embodiment, translation of the operating member 30 back to the recessed position, such as by application of a force to the front surface 32, operates the lock member LM, for example to release a door. In addition, translation of the operating member 30 back to the recessed position may also cause the control member 46 to automatically reengage a portion of the operating member 30.

In another embodiment, the lock core 20 may additionally include a core removal mechanism (not shown). Upon receipt of a unique identification signal, the actuator 42 rotates the control member 46 about axis Y to a second position, distinct from the first position. In this second position, the operating member 30 couples to the core removal mechanism. The core removal mechanism may be configured for use in replacing the battery 41 or for other purposes known to a person having ordinary skill in the art.

By retaining the operating member 30 in a retracted position, recessed within the lock core 20 until a valid authentication signal is provided, the lock core 20 is resilient to unauthorized access. The lock core 20 may be arranged within the thickness of a door, such that the front surface 32 of the operating member 30 is substantially flush with the plane of the door. Because the operating member 30 generally does not take up any extra space outside of the lock core 20, the lock core 20 will also be less susceptible to vandalism.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A lock core for a lock assembly, comprising:

a housing having a first end;

an operating member configured to move between a retracted position and an extended position, wherein when the operating member is in the retracted position, the operating member is at least partially recessed within the housing; and a control member arranged within the housing and configured to selectively limit movement of the operating member between the retracted position and the extended position;

a first biasing mechanism configured to bias the operating member from the retracted position to the extended position;

a second biasing mechanism extending between the actuator and the control member, such that activation of the actuator creates a stored energy in the second biasing mechanism;

wherein engagement between the control member and a portion of the operating member retains the control member first position after the stored energy is created in the second biasing mechanism; and wherein the stored energy in the second biasing mechanism biases the control member out of engagement with the operating member when a force is applied to the operating member.

2. The lock core according to claim 1, wherein the operating member is generally non-round in shape.

3. The lock core according to claim 1, wherein when the operating member is in the retracted position, a front surface of the operating member is generally flush with the first end of the housing.

4. The lock core according to claim 1, wherein the control member is configured to engage a portion of the operating member to limit movement thereof.

5. The lock core according to claim 4, wherein the controller is operably coupled to the actuator and is configured to activate the actuator to move the control member to a first position out of engagement with the operating member upon receipt of a valid authentication signal.

6. The lock core according to claim 4, wherein the operating member includes at least one engagement area, and the control member is configured to engage the at least one engagement area of the operating member to limit movement of the operating member from the retracted position.

7. The lock core according to claim 6, wherein the control member includes a contact portion extending partially about its periphery.

8. The lock core according to claim 1, wherein a lock member is operably coupled to the operating member and application of a force to the operating member, when in the extended position, operates the lock member.

9. The lock core according to claim 8, wherein the operating member is configured to bias to the retracted position once the lock member is operated.

10. The lock core according to claim 8, wherein movement of the operating member from the extended position to the retracted position causes the control member to engage a portion of the operating member.

11. A lock core for a lock assembly, comprising:

a housing having a first end;

an operating member configured to move between a retracted position and an extended position, wherein when the operating member is in the retracted position, the operating member is at least partially recessed within the housing;

a control member arranged within the housing and configured to selectively limit movement of the operating member between the retracted position and the extended position; the control member being operably coupled to a controller via an actuator, wherein the control member is configured to engage a portion of the operating member to limit movement thereof;

a core removal mechanism, wherein the controller is operably coupled to the actuator and is configured to activate the actuator to move the control member to a second position out of engagement with the operating member such that the operating member couples to the core removal mechanism upon receipt of a unique identification signal.

* * * * *